US011044952B1

(12) United States Patent
Hibler

(10) Patent No.: US 11,044,952 B1
(45) Date of Patent: Jun. 29, 2021

(54) PROTECTIVE OVERLAY WITH INTEGRAL CRUMB CATCHER

(71) Applicant: Sticky Bibs, Ltd., Pickerington, OH (US)

(72) Inventor: Stanley A. Hibler, Pickerington, OH (US)

(73) Assignee: Sticky Bibs, Ltd., Pickerington, OH (US)

( * ) Notice: Subject to any disclaimer, the term of this patent is extended or adjusted under 35 U.S.C. 154(b) by 58 days.

(21) Appl. No.: 16/431,078

(22) Filed: Jun. 4, 2019

Related U.S. Application Data

(60) Provisional application No. 62/680,771, filed on Jun. 5, 2018.

(51) Int. Cl.
*A41B 13/10* (2006.01)

(52) U.S. Cl.
CPC ..... *A41B 13/10* (2013.01)

(58) Field of Classification Search
CPC ... A41B 13/10; A41B 13/103; A41B 13/0518; A41B 2400/44; A41B 2400/70; A41B 2400/72
USPC ..... 2/49.1, 49.2, 49.4, 49.5
See application file for complete search history.

(56) References Cited

U.S. PATENT DOCUMENTS 2,425,961 A * 8/1947 Shattuck ..... 2/49.3
3,398,438 A * 8/1968 Fried ..... A41B 13/10 24/7
3,488,773 A * 1/1970 Stemmer ..... A41B 13/10 2/52
4,114,199 A * 9/1978 Malan ..... A41B 13/103 2/49.3
4,261,057 A * 4/1981 Andersson ..... A41B 13/103 2/49.3
4,288,877 A * 9/1981 Klepfer ..... A41B 13/10 2/48
4,601,065 A * 7/1986 Sigl ..... A41B 13/103 2/49.2
4,660,226 A * 4/1987 Quilling ..... A41B 13/103 2/49.2
4,663,779 A * 5/1987 Bible ..... A41B 13/103 2/49.3
4,793,004 A * 12/1988 Long ..... A41B 13/103 2/49.3

(Continued)

FOREIGN PATENT DOCUMENTS

GB 2232340 A * 12/1990 ..... B32B 23/08
GB 2378634 A * 2/2003 ..... A41B 13/103

*Primary Examiner* — Katherine M Moran
*Assistant Examiner* — Grace Huang
(74) *Attorney, Agent, or Firm* — Mueller Law, LLC; Jerry K. Mueller, Jr.

(57) ABSTRACT

A protective overlay for protecting a wearer is formed from a flexible sheet having a front surface, a back surface, a periphery, and a bottom; a pressure sensitive adhesive applied to substantially all of the periphery of the back surface for adhering the flexible sheet to the wearer; a release liner covering the pressure sensitive adhesive and being scored upwardly from the bottom of the flexible sheet; a crumb catcher formed by a bottom section of the flexible sheet being folded upwardly on the flexible sheet front surface and the sides being pushed inwardly to form a gusset. The release liner opposite the crumb catcher remains in place when the remaining release liner is removed for use.

4 Claims, 3 Drawing Sheets

(56) References Cited

U.S. PATENT DOCUMENTS 4,884,299 A * 12/1989 Rose ..... B65D 83/0882 206/390
4,924,527 A * 5/1990 Hintermeyer ..... A41B 13/103 2/46
4,930,500 A * 6/1990 Morgan ..... A61L 15/58 602/48
5,405,486 A * 4/1995 Sablotsky ..... A61F 13/0276 156/250
5,491,844 A * 2/1996 Kehl ..... A41B 13/10 2/243.1
5,881,382 A * 3/1999 Bernard ..... A41B 13/10 2/48
5,956,763 A * 9/1999 Blackshear ..... A41B 13/106 2/46
5,963,986 A * 10/1999 Deppen ..... A41B 13/10 2/49.1
6,219,846 B1 * 4/2001 Toole ..... A41B 13/103 2/49.2
6,256,788 B1 * 7/2001 Loewer ..... A41B 13/103 2/49.2
6,334,220 B1 * 1/2002 Frye ..... A41B 13/103 2/49.2
6,493,879 B1 * 12/2002 Hibler ..... A41B 13/10 2/49.1
6,787,681 B2 * 9/2004 Murakami ..... A61L 15/24 602/54
6,789,265 B1 * 9/2004 Vonrinteln ..... A41B 13/103 2/48
6,826,780 B1 * 12/2004 Romesburg ..... A41B 13/103 2/48
7,103,916 B1 * 9/2006 Goodew ..... A41B 13/10 2/49.1
7,360,257 B2 * 4/2008 Friedland ..... A41B 13/10 2/49.1
7,380,284 B1 * 6/2008 Dodani ..... A41B 13/10 2/49.1
8,524,338 B2 * 9/2013 Anderson ..... A41D 13/0155 428/34.1
8,881,312 B2 * 11/2014 Zuccarello ..... A41B 13/10 2/49.1
9,386,806 B2 * 7/2016 Bailey ..... A41B 13/10
10,390,570 B2 * 8/2019 Petersen ..... A47G 19/08
2005/0235394 A1 * 10/2005 Pew ..... A41B 13/10 2/111
2006/0026729 A1 * 2/2006 Rothschild ..... A41B 13/10 2/49.1
2008/0178772 A1 * 7/2008 Roach ..... B65F 1/10 108/26
2011/0209261 A1 * 9/2011 Lyle ..... A63H 33/006 2/49.1
2012/0204305 A1 * 8/2012 Smith ..... A41B 13/103 2/52
2013/0086725 A1 * 4/2013 Sabre ..... A41B 13/106 2/49.2
2014/0096300 A1 * 4/2014 Ross ..... A41B 13/103 2/49.2
2015/0157509 A1 * 6/2015 Atkinson ..... A61F 2/50 604/290

* cited by examiner

FIG. 5
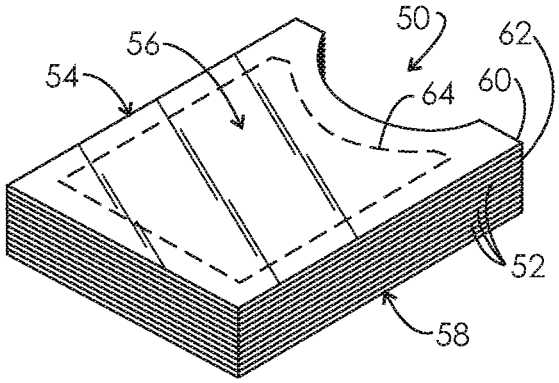
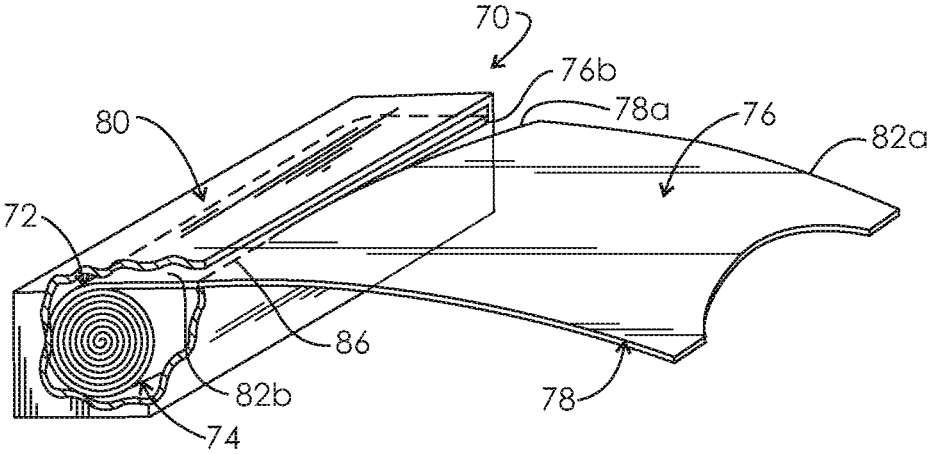
FIG. 6

PROTECTIVE OVERLAY WITH INTEGRAL CRUMB CATCHER

CROSS-REFERENCE TO RELATED APPLICATIONS

This application claims benefit of provisional application 62/680,771 filed on Jun. 5, 2018.

STATEMENT REGARDING FEDERALLY SPONSORED RESEARCH AND DEVELOPMENT

None.

THE NAMES OF THE PARTIES TO A JOINT RESEARCH AGREEMENT

Not applicable.

REFERENCE TO A "SEQUENCE LISTING," A TABLE, OR A COMPUTER PROGRAM

Not applicable.

STATEMENT REGARDING PRIOR DISCLOSURES BY THE INVENTOR OR A JOINT INVENTOR

Not applicable.

BACKGROUND OF THE INVENTION

Anyone who has fed an infant or had the opportunity to observe a baby eat knows all too well the difficult task of getting food into the child's mouth. Quite often, the goal in feeding an infant is simply to get more food into his or her mouth than on the child and surrounding eating area. Food, almost inevitably then, finds its way onto the child's clothes, which can soil and permanently stain the clothing. Bibs, therefore, are often used to minimize the scattering of food and to protect the child's clothing from food stains.

Conventional bibs are formed from cloth or other absorbent material and typically have two strings, which tie around the child's neck to hold the bib in place. Other bibs are formed from plastic and use snaps, ties, strings, hook and loop fasteners, or the like to attach around the child's neck. More recently, some bibs have eliminated the strings and ties altogether and have instead used adhesive strips. These strips are located near the shoulder area on the backside of the bib and are used to adhere the bib to the wearer.

Particularly with younger children and infants, the bibs heretofore known in the art have not always adequately kept food and other stains from reaching the child's clothing. One common problem encountered with feeding infants, in particular, is keeping the bib on the front of the child in an orientation, which actually protects the clothing. This task is not always that simple. Infants almost instinctively tend to put everything in their mouth. Often, then, the first thing an infant wants to do is remove the bib from its useful location to his or her mouth. In other instances, the infant or child simply may not want to wear the bib and attempt to move it. Even children capable of feeding themselves may, after determining they are finished, reach down to prematurely remove their bib. The removal of the bib, however, may occur before the child's hands, face, and eating area have been cleaned. In other instances, the bib may accidentally catch on the child's hand or otherwise lift up and expose the child's clothing to food. In these situations, an extra hand for a parent, baby sitter, or caretaker faced with the responsibility of holding the bib down with one hand and feeding the child with the other would be helpful. Since such added help, or extra hands, are typically not available, food often ends up on the infant and the infant's clothes despite the bib.

Another prior encountered problem is that many bibs are unable to effectively and completely prevent food and saliva from staining the infant's cloths near the neck region. Infants, for example, cannot easily control salivation, and it is not uncommon for food and saliva to run down their cheek to their clothes through openings in the neck portion of the bib. Many bibs use strings, ties, straps, or the like to fasten around the baby's neck. In order to assure a comfortable fit, however, the bib must be fastened somewhat loosely, so as not to choke the child. Inevitably then, a gap is created through which food may fall or drop. A similar problem exists with bibs that use adhesive straps to secure the bib to the infant. These bibs commonly only have adhesive at the shoulder areas. As such, food may pass through openings along the neck portions, which are not directly adhered to the overlay.

Compared to children, adults are much less apt to spill or splatter food onto their clothing. Napkins, then, are typically used instead of bibs to protect clothing. However, certain foods, such as shelled lobster and spaghetti, tend to be quite messy even for adults eating with care. In these situations, a napkin may not adequately keep food off clothing. Bibs would be practical but are often not used because of the stereotype associated with wearing a bib. A bib that not only fully protects the wearer but also remains inconspicuous would be especially welcome by adult diners.

Such a bib is disclosed in U.S. Pat. No. 6,493,879. A problem even with this unique bib is the food that spills down onto the bib. While the user is protected, some of the spilled food can slide down and onto the lap of the user. It is to such problem that the current disclosure is addressed.

BRIEF SUMMARY OF THE INVENTION

The present disclosure is directed to a self-adhering protective overlay such as a bib, apron, napkin, or the like which securely adheres to a wearer or wearer's clothes without the addition of snaps, ties, strings, or the like. A flexible sheet is employed which has a front surface, a back surface, and a periphery. A pressure sensitive adhesive (PSA) is applied to at least substantially the entire periphery on the back surface for adhering the flexible sheet to the wearer. The entire back surface of the bib may be coated with the PSA. Once this adhesive is adhered to the wearer, the protective overlay may not readily be removed and, as such, is particularly advantageous for use on infants and small children.

In one embodiment, a removable release sheet is adhered to the pressure sensitive adhesive prior to use for protecting against unwanted adhesion. After the release sheet is removed, the flexible sheet may be used and then re-adhered to the release sheet for subsequent use. Alternatively, once the flexible sheet is used, it may be discarded.

As an additional advantage, the protective overlay may be manufactured from a durable, lightweight material, which is extremely inexpensive. Further, graphics such as designs, emblems, prints, or alphanumeric characters may be placed or printed on the protective overlay to enhance its aesthetic value. Alternatively, the protective overlay may be transparent so that it is virtually unnoticeable when worn.

As another feature, a plurality of flexible sheets are arranged to form a protective overlay dispensing system. In this system, flexible sheets, without the addition of the release sheet, are arranged in a stack. Individual sheets may be removed from the stack, used, and re-adhered to the stack for subsequent use. In one embodiment, the flexible sheets are superimposed on one another to form a vertical stack. In another embodiment, the flexible sheets are attached at adjacent ends to form a rolled stack.

The integral crumb catcher may be formed by folding up a small section at the bottom of the bib. Then the two corners on either side of the bib bottom are folded inwardly to form a gusset. The release liner, however, is not removed from the backside of the bib forming the crumb catcher. The release liner, then, becomes a stiffener for the crumb catcher such that no adhesive or other securing means are required (but are optional) in order to keep the crumb catcher in its structural and useful configuration.

Other advantages of the disclosure will, in part, be obvious and will appear hereinafter. The disclosure, accordingly, comprises the apparatus and method possessing the construction, combination of elements, and arrangements of parts that are exemplified in the following detailed disclosure.

BRIEF DESCRIPTION OF THE SEVERAL VIEWS OF THE DRAWINGS

For a fuller understanding of the nature and advantages of the present disclosure, reference should be had to the following detailed description taken in connection with the accompanying drawings, in which:

FIG. 5 shows a stack of protective overlays;

FIG. 6 shows a roll of protective overlays housed in a container whereby protective overlays are pulled out of the container separately and torn off for use.

The drawings are described in detail below.

DETAILED DESCRIPTION OF THE INVENTION

Foods and drinks tend to stain clothes, and in some instances, these stains are not readily removed. During meals and eating time, then, protective overlays such as bibs, napkins, aprons, or the like are commonly worn around the neck, on the lap, over the shoulder, or on the chest over clothing to protect from unwanted contact with food or drink. Any food, drink, or other material not sticking to the bib slides down the front surface of the bib and into the integrally formed crumb catcher. The present disclosure is directed toward such a protective overlay with integral crumb catcher.

Figure 1:
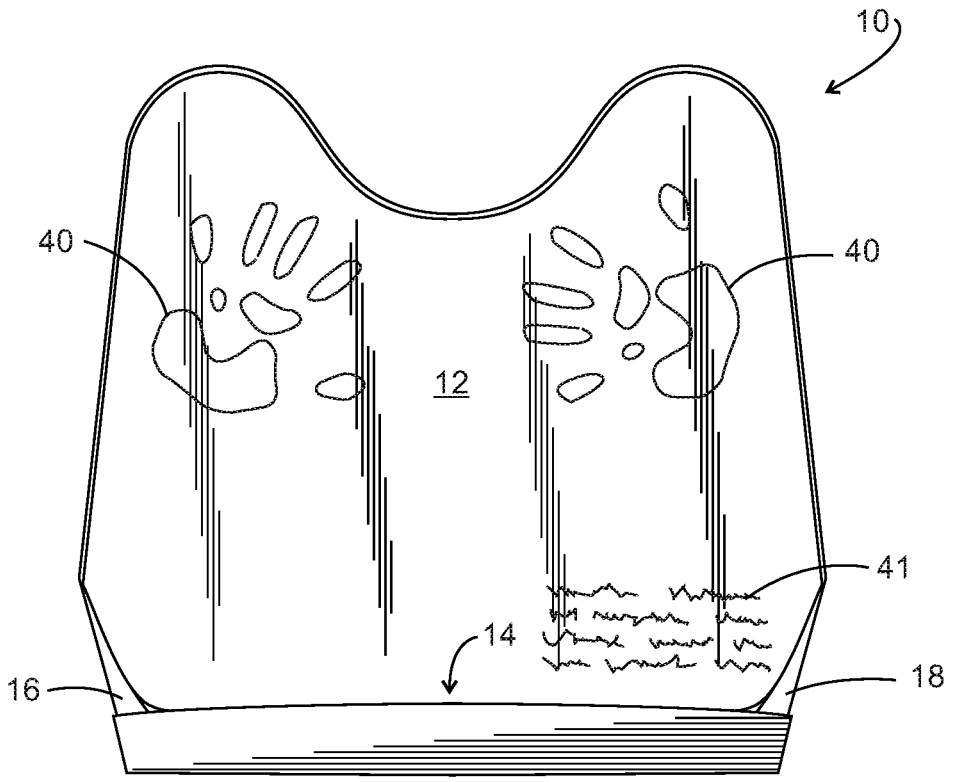
FIG. 1 is a front view of the disclosed bib with integral crumb catcher.

Looking to FIG. 1, the disclosed bib, 10, contains a U-shaped cutout at its top to fit around the neck of a user. The front surface, 12, is imprinted with graphics and is, in fact, an infant or toddler's bib, as shown. An integral crumb catcher, 14, terminates the bottom of bib 10. While the drawings and instant description is for a bib, broadly, it is a flexible sheet with an adhesive back.

Figure 2:
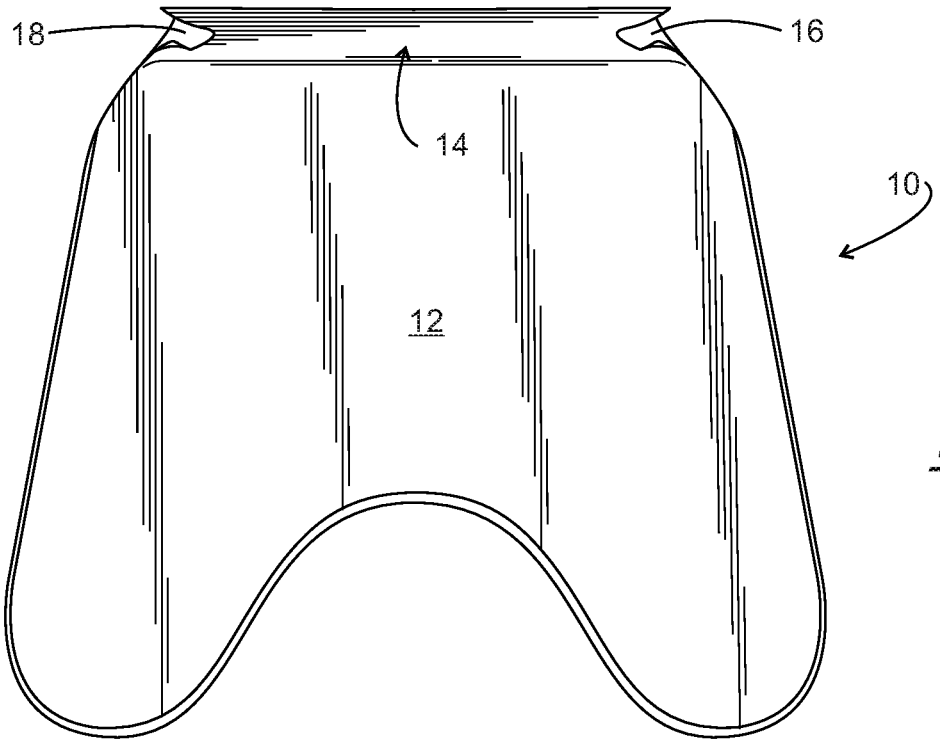
FIG. 2 also is a front view of the upside down disclosed bib showing the crumb catcher side gussets.
Figure 3:
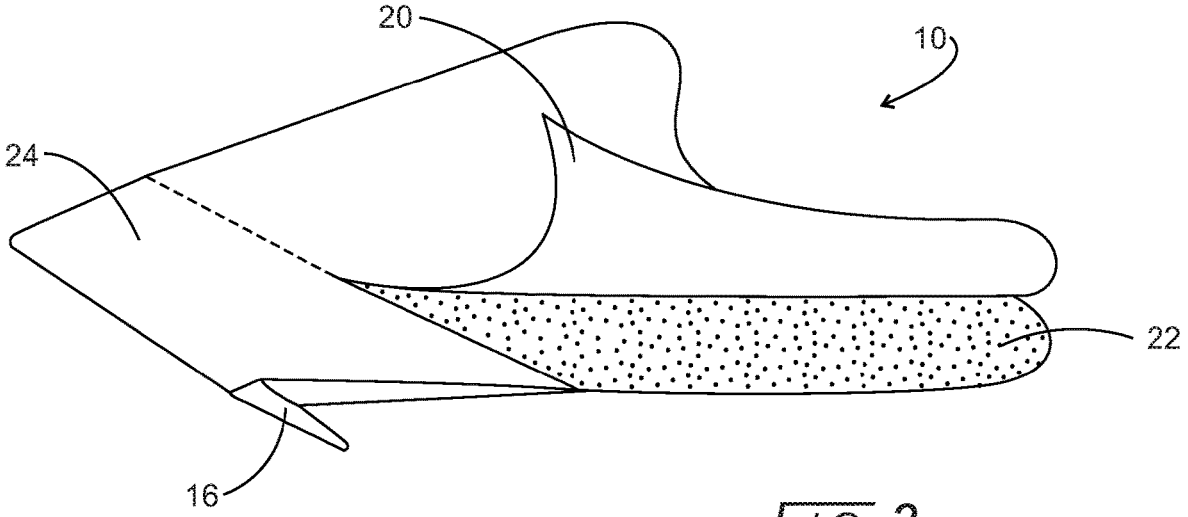
FIG. 3 is an isometric view of the backside of the disclosed bib with the release liner(s) being partially removed.

From FIG. 2, folding up a section of the bottom of bib 10 forms integral crumb catcher 14. The sides are folded inwardly for forming gussets, 16 and 18. As seen in FIG. 3, a release liner, 20, is removed from the back surface of bib 10 to reveal the adhesive, 22, on the back surface of bib 10. Such release liner 20 can be scored and come in separate sections for removal. Importantly, a release liner section, 24, on the rear side of bib 10 is not removed and for that purpose, a score is made in the release liner so that such release liner section 24 stays in place and is not removed. Release liner 24 provides stiffness to crumb catcher 14 and to gussets 16 and 18.

Figure 4:
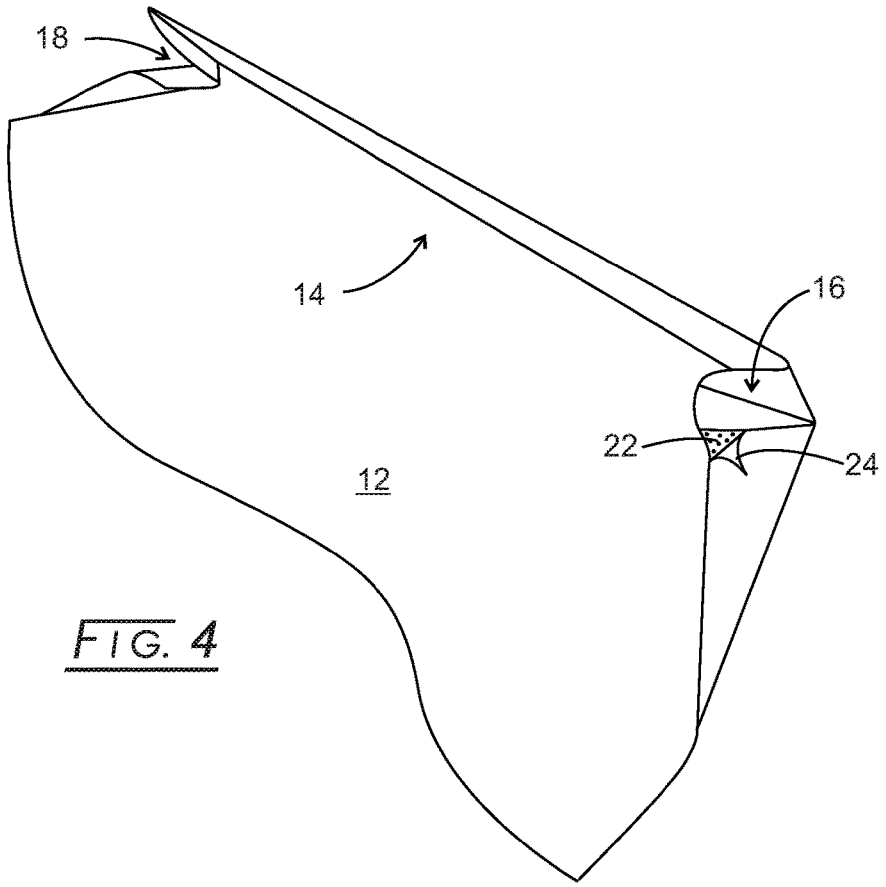
FIG. 4 is a front view of the integral crumb catcher again showing the integral gussets of the crumb catcher.

Looking to FIG. 4, a portion of release liner section 24 inside gusset 16 could be cut out and removed to reveal adhesive to assist in keeping gusset 16 in its folded state. Alternatively, an adhesive dot or other adhesive could be applied at this location for the same purpose. With the presence of release liner 20 on the rear side of crumb catcher 14, such adhesive to secure the gussets are unnecessary, but permissive.

Bibs and the like are worn to protect wearers, and in particular, clothing from food, drink, soil, and related stains. In this regard, flexible sheet 10 may be formed of various materials, which protect wearers from food, drink, and soils. Protective overlay system 10, for example, may be made from multi-ply paper stock, cloth, polymers, or other suitable material, alone or in combination, for protecting the wearer. Flexible sheet 10 may be formed from a high density polyethylene, a polyester, or a polyester blend. For example, front surface 12 of flexible sheet 10 preferably is made of a material sufficient to inhibit the penetration of food, drink or soil to the clothing of the wearer such absorbent paper, thermoplastic, or other polymeric material. Preferably, flexible sheet 10 is formed from Tyvek® spunbonded olefin (a random mat of bonded high density polyethylene fibers, 0.5-10 micrometers, E.I. duPont deNemours and Company, Wilmington, Del.). Alternatively, flexible sheet 10 could be formed from Reprofilm® sheet (1 mil clear polyester matte top coat with acrylic permanent adhesive, Rayven, Inc., St. Paul, Minn.). Additionally, flexible sheet 10 could be formed from Sontera® spunlaced fabric (100% polyester, 70% rayon/30% polyester, or 55% woodpulp/45% polyester fabric, E.I. du Pont de Nemours and Co., Old Hickory, Tenn.).

Not shown in the drawings, graphics, such as, for example, decorative designs, prints, alpha-numeric characters, or the like may be placed or printed on front surface 12 to improve the aesthetics of flexible sheet 10. Additionally, flexible sheet 10 may be made in a variety of colors or, alternatively, made transparent.

Transparent flexible sheets are advantageous in that they are virtually inconspicuous when worn and, as such, may be worn by adults or children. Flexible sheets of nominally 1 mil or so thickness contribute to their inconspicuous nature due to their being light in weight. The inventive sheets are virtually unnoticeable to the wearer. Instructions may be packaged with protective overlay system 10 and, for example, printed directly on either flexible sheet 10 or release sheet 20. Alternatively, instructions may be printed on a separate sheet (not shown) or otherwise supplied with protective overlay system 10.

Pressure sensitive adhesives are a class of adhesives that exhibit initial tack and peel performance when pressure-applied to a substrate. When the PSA coated sheet is removed from the substrate, removal must be clean, i.e. no visible trace of the adhesive should remain on the substrate.

Reuse of the PSA coated sheet, accordingly, is contemplated. Most PSA compositions are based on one or more acrylate compounds optionally admixed ethylene, acrylamide, and like compounds. PSA compositions are replete in the art and widely available commercially.

One important feature of this disclosure is that flexible sheet 10 may be soiled and thereafter cleaned and reused numerous times. After flexible sheet 10 has been soiled with food, for example, it may be washed with soap and water or wiped off and then reused. In this regard, flexible sheet 10 is durable so as to withstand numerous cleanings, and after each use it may be re-adhered to release sheet 20 and stored for subsequent use. Alternatively, after flexible sheet 10 has been used, it, along with release sheet 20, may be thrown away or otherwise disposed. Protective overlay system 10 is manufactured inexpensively and, therefore, may be disposed or discarded without substantial cost.

Another important feature is that flexible sheet 10 securely adheres to the wearer and may not thereafter be easily removed. Infants, toddlers, and small children, who require a bib during feeding, are prone to remove their bib or otherwise adjust its position, either accidentally or purposely. Flexible sheet 10, however, is not prone to facile removal or repositioning. Its light weight also makes it unnoticeable to the toddler wearers so that they readily forget that they have it on.

Another important aspect of this invention is shown in FIG. 5 in which protective overlays are arranged without the addition of any release sheets. In this embodiment, a protective overlay dispensing system is generally shown at 50. System 50 consists of a plurality of flexible sheets 52 arranged in a stack. FIG. 5 illustrates an exemplary embodiment of one such stack 54 in which flexible sheets 52 are vertically disposed such that each flexible sheet is superimposed on another flexible sheet. Each of the flexible sheets 52 has a front surface 56 and a back surface 58 and is similar to flexible sheet 12 described in FIGS. 1-4. Flexible sheets 52, however, do not employ release sheet 20 shown in FIG. 3. Instead, each of the flexible sheets 52 is adhered to another flexible sheet within stack 54. In this regard, a first or top flexible sheet 60 has its back surface 58 (not shown) adhered to front surface 56 (not shown) of a second flexible sheet 62. Front surface 56 of each flexible sheet is formed from a material able to repeatedly adhere to a pressure sensitive adhesive 64 (shown as a dashed line) located on back surface 58 of each flexible sheet. Top flexible sheet 60 may be separated from second flexible sheet 62 and stack 54 for use. Thereafter, once top flexible sheet 60 is used, it may be re-adhered to second flexible sheet 62 or, alternatively, discarded.

FIG. 6 depicts an alternate embodiment of stack 54 shown in FIG. 5. In FIG. 6, a protective overlay dispensing system is shown generally at 70. System 70 has a plurality of flexible sheets 72 arranged in a stack 74 formed as a roll. Each of the flexible sheets 72 has a top portion 76 and a bottom portion 78 and are generally similar to flexible sheets 12 described in FIGS. 1-4. Stack 74 may be housed or stored in a container or housing 80 which is, for example, made from paper-board, card-board, polymeric material, combination thereof, or the like. Two flexible sheets 82*a* and 82*b* are shown extending from stack 74. A bottom portion 78*a* of flexible sheet 82*a* is adjacent to a top portion 76*b* of flexible sheet 82*b* such that stack 74 is formed from a continuous roll of flexible sheets 72. In this regard, flexible sheets 72 of stack 74 are preferably attached at adjacent ends, as shown with bottom portion 78*a* attached to top portion 76*b*. A perforated line 86 is provided in order to separate one flexible sheet from stack 74. Bottom portion 78*a* of flexible sheet 82*a*, for example, may be pulled and thus separated from top portion 76*b* of flexible sheet 82*b* along perforated line 86. Thereafter, flexible sheet 82*a* may be discarded or re-adhered onto stack 74 and subsequently re-used.

Tyvek®, Reprofilm®, and Sontera® films, for example, are polymeric papers that can have a PSA applied to one side while the other side retains its release properties. Alternatively, front surface 12, then, may be formed from a release material which then is laminated to an adhesive backing or is treated to exhibit release properties for enabling the pressure sensitive adhesive of another flexible sheet to repeatedly adhere thereto. In fact, a double-sided adhesive sheet could be laminated to a polymeric film or paper sheet (e.g., Tyvek®, Reprofilm®, and Santera® films) to form the inventive protective overlay.

While the apparatus, system, and method have been described with reference to various embodiments, those skilled in the art will understand that various changes may be made and equivalents may be substituted for elements thereof without departing from the scope and essence of the disclosure. In addition, many modifications may be made to adapt a particular situation or material in accordance with the teachings of the disclosure without departing from the essential scope thereof. Therefore, it is intended that the disclosure not be limited to the particular embodiments disclosed, but that the disclosure will include all embodiments falling within the scope of the appended claims. In this application all citations referred herein are expressly incorporated herein by reference.

I claim:

1. A protective overlay for protecting a wearer, consisting of:

(a) a flexible sheet having a front surface, a back surface, a periphery, a top, a bottom, a first lateral side, and a second lateral side, said first and second lateral sides extending between the top and the bottom;

(b) a pressure sensitive adhesive applied to at least a portion of the back surface;

(c) a removable release liner covering the back surface of the flexible sheet including the pressure sensitive adhesive, said release liner comprising a bottom section, said release liner and scored laterally from the first lateral side to the second lateral side to form the bottom section;

(d) a crumb catcher having a front and a back, the front formed by both a portion of the bottom section of the release liner and the bottom of the flexible sheet folded upwardly on the flexible sheet front surface, the back formed by the flexible sheet and the remaining bottom portion of the bottom section opposite the upwardly folded front, and the first and second lateral sides at the bottom section of the release liner extending inwardly and forming a gusset, the bottom section of the release liner of the crumb catcher being a stiffener for the crumb catcher, wherein said protective overlay is configured to be applied to said wearer upon removal of said release liner above the bottom section.

2. The protective overlay of claim 1 having a neck recess portion that is U-shaped.

3. The protective overlay of claim 1 in which said flexible sheet is formed from a high density polyethylene, a polyester, or a polyester blend.

4. The protective overlay of claim 3 in which said flexible sheet is formed from a transparent material.

* * * * *